United States Patent [19]

Morita

[11] Patent Number: 4,712,932

[45] Date of Patent: Dec. 15, 1987

[54] RIBBON GUIDE DEVICE

[75] Inventor: Toshiki Morita, Toyoake, Japan

[73] Assignee: Brother Kogyo Kabushiki Kaisha, Japan

[21] Appl. No.: 883,433

[22] Filed: Jul. 14, 1986

Related U.S. Application Data

[63] Continuation of Ser. No. 693,808, Jan. 23, 1985, abandoned.

[30] Foreign Application Priority Data

Jan. 28, 1984 [JP] Japan ..... 59-10869[U]
Jan. 28, 1984 [JP] Japan ..... 59-10870[U]

[51] Int. Cl.[4] ..... B41J 32/02
[52] U.S. Cl. ..... 400/208.1; 400/196.1
[58] Field of Search ..... 400/196, 196.1, 208, 400/208.1, 693, 693.1

[56] References Cited

U.S. PATENT DOCUMENTS

| | | | |
|---|---|---|---|
| 2,165,739 | 7/1939 | Verkinderen | 400/208.1 |
| 2,873,015 | 2/1959 | Gray | 400/208.1 |
| 3,396,828 | 2/1966 | Moshier et al. | 400/208.1 |
| 4,026,403 | 5/1977 | Inose et al. | 400/693 |
| 4,046,247 | 9/1977 | Laspesa et al. | 400/196 |
| 4,325,645 | 4/1982 | Miyajima et al. | 400/208 |
| 4,350,452 | 9/1982 | Dials et al. | 400/208 |
| 4,352,575 | 10/1982 | Shore | 400/208 |
| 4,413,920 | 11/1983 | Matthias et al. | 400/208 |
| 4,468,143 | 8/1984 | Volke et al. | 400/196 |
| 4,469,457 | 9/1984 | Chida et al. | 400/208 |
| 4,480,936 | 11/1984 | Kasnn et al. | 400/208 |

FOREIGN PATENT DOCUMENTS

| | | | |
|---|---|---|---|
| 19649 | 12/1980 | European Pat. Off. | 400/208.1 |
| 2358180 | 5/1975 | Fed. Rep. of Germany | 400/208 |
| 18286 | 1/1982 | Japan | 400/208 |
| 57-101046 | 6/1982 | Japan | 400/208 |
| 2091685 | 8/1982 | United Kingdom | 400/208 |

*Primary Examiner*—William Pieprz
*Attorney, Agent, or Firm*—Jones, Tullar & Cooper

[57] ABSTRACT

In a ribbon guide device used in a printing machine, a second ribbon guide arm member out of first and second ribbon guide arm members provided individually at a pair of ribbon aperture portions of a ribbon cassette can be attached to and removed from the ribbon cassette. An effective printing ribbon portion is stretched between the first and second ribbon guide arm members. When the second ribbon guide arm member is attached to the ribbon cassette, the stretched ribbon portion covers a part of the traveling stroke of the printing head. The second ribbon guide arm member can also be attached to and removed from a mounting section of the frame of the printing machine. When the second ribbon guide arm member is attached to the mounting section, the stretched ribbon portion covers the whole traveling stroke of the printing head.

9 Claims, 5 Drawing Figures

RIBBON GUIDE DEVICE

CROSS REFERENCE TO RELATED APPLICATION

This is a continuation of co-pending application Ser. No. 693,808, filed on Jan. 23, 1985, and now abandoned.

BACKGROUND OF THE INVENTION

The present invention relates to a ribbon guide device which is provided in a printing machine, such as a typewriter, word processing equipment, or the output machine of a computer.

In general, in printing machines of this type, printing paper on an elongate platen extending along a printing line is printed by the use of, for example, a fabric or carbon ribbon for a dot printer or a thermal transfer ribbon which is interposed between the platen and a printing head facing the platen and reciprocating through a predetermined traveling stroke along the printing line. The ribbon is contained in a ribbon cassette (generally referred to also as a ribbon cartridge) which constitutes ribbon supply means, and is partially exposed from the cassette through a pair of ribbon apertures. The exposed portion of the ribbon is stretched throughout the traveling stroke of the printing head, constituting an effective printing ribbon portion.

The exposed ribbon portion is movably supported by and stretched between a pair of ribbon guide members which constitute ribbon guide arm means disposed individually corresponding to the two ribbon apertures.

The traveling stroke of the printing head, i.e., the maximum printing width, is defined in accordance with the maximum width of the recording paper used. If the effective printing ribbon portion is to cover the whole traveling stroke, the ribbon cassette or ribbon supply means itself need be long enough to extend throughout the traveling stroke. In this case, however, the ribbon guide device including the ribbon guide means will become bulky and requires a substantial space inside the printing machine, complicating the layout of other components such as a drive mechanism including a motor. Thus, it is difficult to reduce the general size of the printing machine. Moreover, the ribbon cassette requires a wider storage space when unloaded from the printing machine.

As a means for settling the above problem, ribbon guide devices are conventionally known in which one of two guide arm members is slidable or rockable relatively to the body portion of a cassette so that a longer effective printing ribbon portion is secured by sliding or rocking the guide arm member. One such prior art ribbon guide device is disclosed in, for example, Japanese Utility Model Disclosure No. 57-101046.

However, in the disclosed ribbon guide device, whether of a slide type or of a rocking type, the extension length of the ribbon guide arm member cannot be made very great. A greater extension length would highly complicate the construction of associated members. Therefore, the ribbon guide device of this type cannot easily be applied to printing machines with a great maximum printing width.

In the device described above, moreover, it is necessary to secure the traveling stroke of the sliding or rocking ribbon guide arm member as a required space inside the printing machine, so that other components must be arranged without interfering with such space. Thus, problems still remain unsettled as regards the difficulty of the layout of the individual members and of miniaturization.

SUMMARY OF THE INVENTION

Accordingly, the object of the present invention is to provide a ribbon guide device which settles or eliminates the aforesaid problems or drawbacks of the prior art ribbon guide device, which permits the length of an effective printing ribbon portion to be freely extended over the whole traveling stroke of a printing head, which requires only a small space even when extended, thereby facilitating the layout of other components and miniaturization, and which is high in operating efficiency, simple in construction, and low in manufacturing cost.

In order to achieve the above object, according to the present invention, at least one, e.g., second ribbon guide arm means, out of first and second ribbon guide arm means which are disposed individually corresponding to a pair of ribbon apertures of ribbon supply means is removably mounted on the ribbon supply means.

As disclosed in the present invention, the second ribbon guide device removed from the ribbon supply means is removably attached to a machine frame of a printing machine without being positionally restricted with respect to the ribbon supply means. Thus, the length of the effective printing ribbon portion exposed from the ribbon supply means can very easily be set to be greater than the maximum printing width of the printing head.

The second ribbon guide arm means can be formed from a single block-shaped member, and can be integrally formed from plastic material with ease. Accordingly, it is simple in construction and can easily be fabricated at low cost. Also, the second ribbon guide arm means can be slidably attached to or removed from the ribbon supply means or a mounting section on the machine frame with smoothness.

A planar rectangular ribbon cassette of a conventional construction is used for the ribbon supply means, and a pair of ribbon apertures are formed individually at two adjacent corner portions of the ribbon cassette. The first ribbon guide arm means is disposed corresponding to one of the ribbon apertures, and the second ribbon guide arm means to the other aperture. Since the second ribbon guide arm means can be selectively attached to or removed from the mounting section of the machine frame or its corresponding corner portion of the cassette, the layout of other components and reduction in general size are further facilitated.

The second ribbon guide arm means is formed from a single member, and can be attached to or removed from the planar cassette along a plane parallel to the main surface of the cassette. Moreover, it can be attached to or detached from the machine frame at right angles to its plane. Thus, mounting sections to fit the cassette and the machine frame can be organically dispersedly formed on the single member, permitting reduction in size of the member.

These and other objects and advantages of the present invention will become apparent from the following description when read in conjunction with the accompanying drawings wherein:

DETAILED DESCRIPTION OF THE PREFERRED EMBODIMENT

Figure 1:
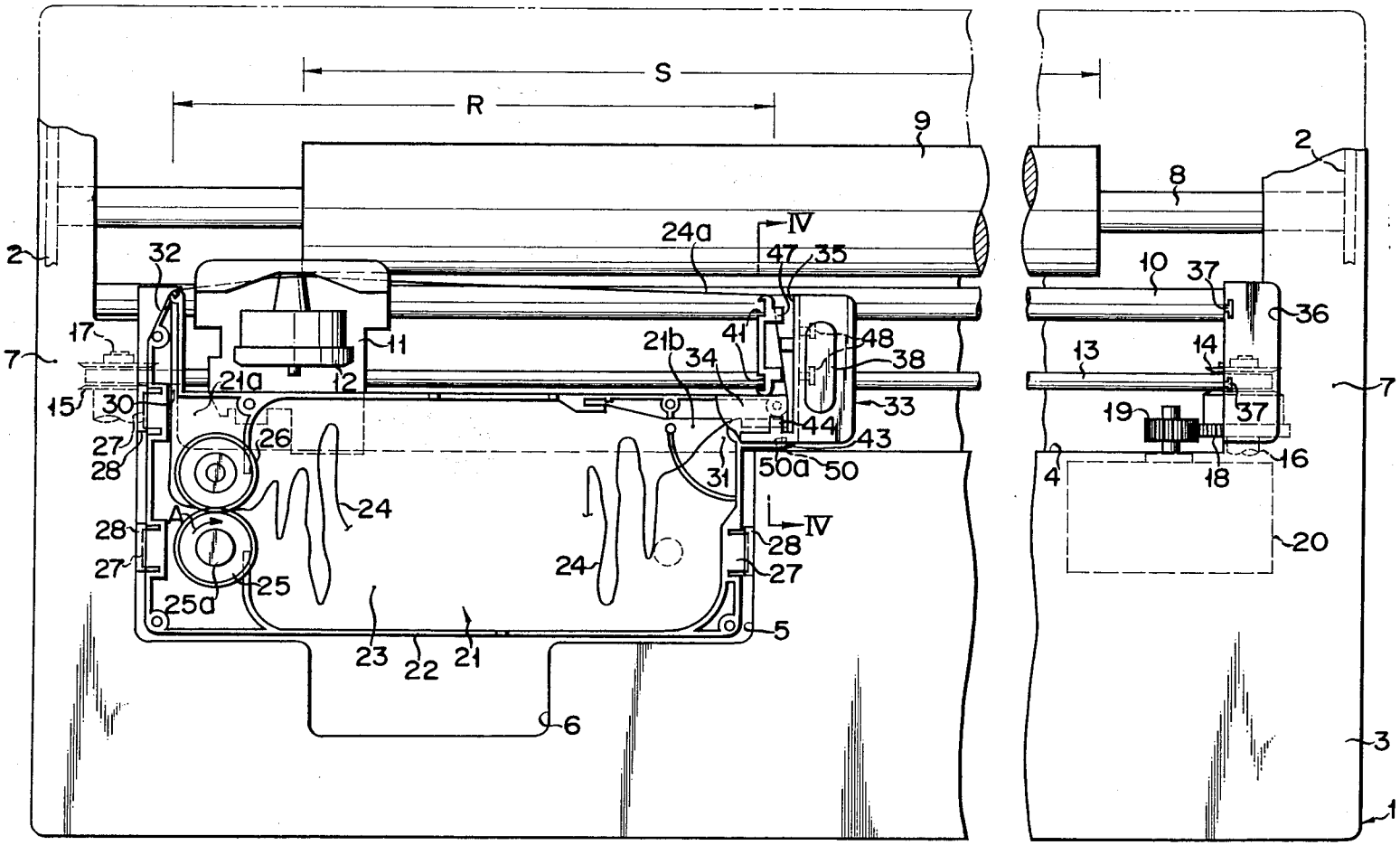
FIG. 1 is a cutaway plan view of a printing machine provided with a ribbon guide device according to the present invention, showing a state in which a second ribbon guide arm member is attached to a ribbon cassette.

As shown in FIG. 1, a printing machine with a ribbon guide device according to the present invention includes a machine frame 1, which comprises a supporting frame 2 (indicated by broken lines) for supporting various internal mechanism portions and a cover member 3 covering the top surface of the printing machine. The cover member 3 is made of plastic material, and includes a notch portion 4 extending horizontally at its central portion, a rectangular holding recess 5 for holding a ribbon cassette, and a finger recess 6 continuous with the recess 5. Cover side portions 7 are left on either side of the notch portion 4.

Figure 2:
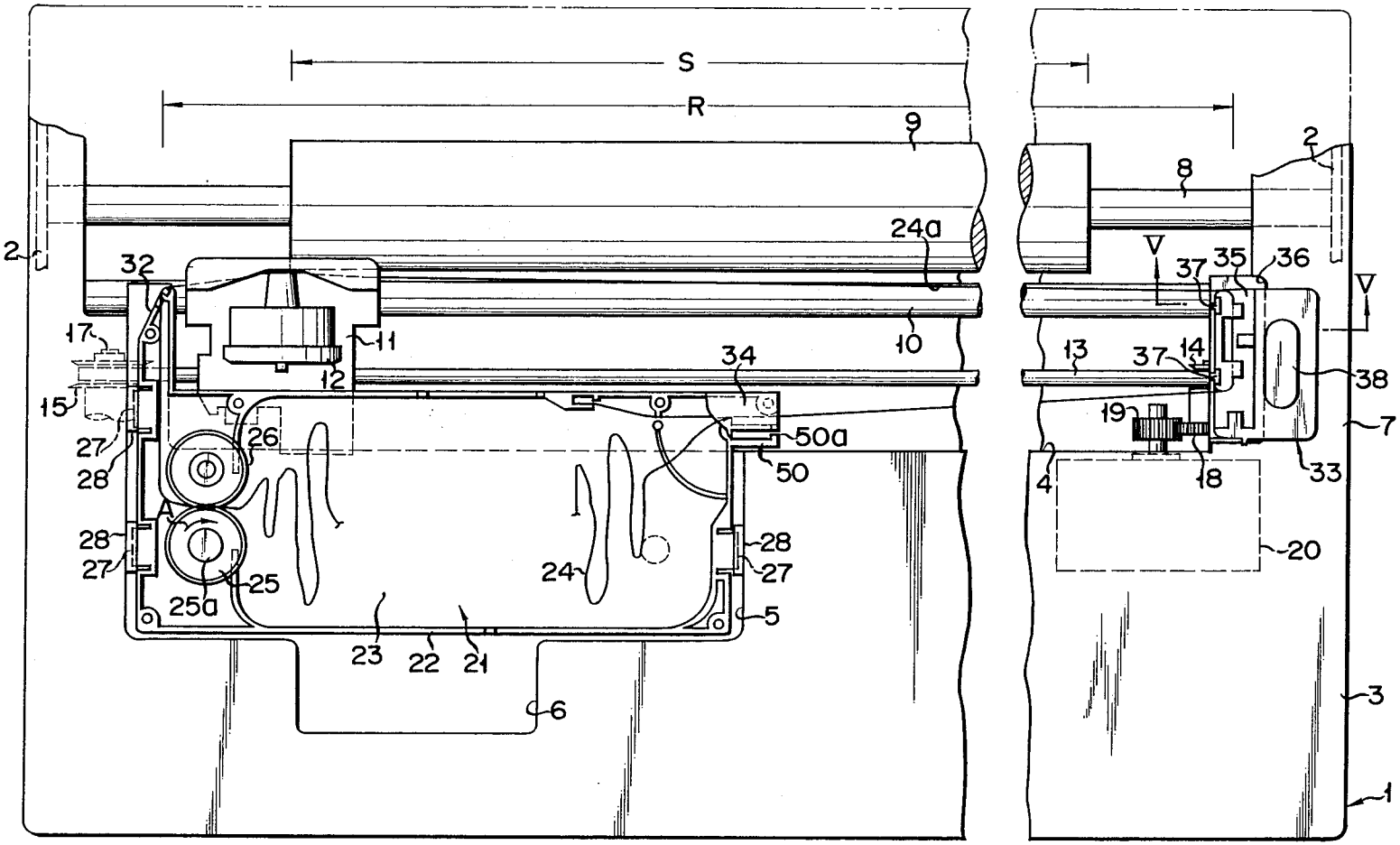
FIG. 2 is a plan view similar to FIG. 1, showing a state in which the second ribbon guide arm member is mounted on a machine frame.

In FIGS. 1 and 2, the upper and lower sides of the drawing are defined as the front and rear sides, respectively, of the printing machine.

A rotating shaft 8 is rotatably supported on the supporting frame 2, and a platen 9 is fixed on the rotating shaft 8, extending in the transverse direction of the printing machine. A guide shaft 10 is attached to the supporting frame 2, extending parallel to and in front of the platen 9. A carriage 11 is slidably supported on the guide shaft 10, and a printing head 12 of a wire-dot type is mounted on the carriage 11. The carriage 11 is slidably supported by another guide shaft (not shown) located in front of the carriage 11 and extending parallel to the guide shaft 10, as well as by the shaft 10.

A toothed endless drive belt 13 is fixed at its upper belt portion to the carriage 11. The belt 13 extends crosswise so as to be parallel to the platen 9. The right-hand end portion of the belt 13 is passed around a driving pulley 14, and the left-hand end portion around a driven pulley 15. The driving pulley 14 and the driven pulley 15 are mounted on a driving shaft 16 and a driven shaft 17, respectively. A reversible drive motor 20 is coupled to the driving shaft 16 by means of gears 18 and 19. The motor 20 is disposed under the cover member 3, located in the right-hand region of the printing machine. The motor 20 and the shafts 16 and 17 are supported on the supporting frame 2 (connection is not shown).

If the motor is rotated in the forward direction, the printing head 12, along with the carriage 11, is advanced from left to right of FIG. 1 through the medium of the belt 13. If the motor 20 is rotated reversely, the printing head 12 on the carriage 11 is returned from right to left of FIG. 1, correspondingly.

In FIGS. 1 and 2, the printing head 12 is at a standstill at the left-hand end position of the traveling stroke S of its reciprocation. The printing head 12 travels along a printing line on the platen 9, and the traveling stroke S equivalently represents the maximum printing width permitted. A printing sheet wound around the platen 9 is not shown.

A ribbon cassette 21 constituting ribbon supply means is removably set in the holding recess 5 in the cover member 3. The cassette 21 is in the form of a planar, rectangular plate, including a cassette housing 22. In FIGS. 1 and 2, the cassette housing 22 is cleared of its top cover. The greater part of an endless fabric ribbon 24 is stored in a ribbon chamber 23 of the housing 22. As in a conventional ribbon cassette, the ribbon 24 is contained in zigzags in the ribbon chamber 23. The housing 22 is formed from plastic material.

As a toothed feed roller 25 rotatably disposed in the left-hand portion of the cassette housing 22 rotates in the direction of arrow A, the ribbon 24 is fed gradually, held between the feed roller 25 and a toothed driven roller 26 which is in mesh with the roller 25 to be driven thereby for rotation. The roller 25 is coupled to a drive section (not shown) in the printing machine so that it is driven when the printing head 12 advances and is stopped when the printing head 12 returns. To attain this, a one-way clutch is provided between the roller 25 and the drive section. The construction of this roller drive system may be conventional and does not constitute any principal feature or advantage of the present invention.

Three elastic detent pieces 27 are integrally formed on the outer surface of the housing 22 on either lateral side thereof. On the other hand, detent projections 28 are formed on the peripheral edge portion of the holding recess 5. As the detent pieces 27 engage their corresponding detent projections 28, the ribbon cassette 21 is held in position in the holding recess 5.

Ribbon apertures 30 and 31 are formed in the housing 22 of the ribbon cassette 21 at two adjacent corner portions 21*a* and 21*b*, respectively, on the side facing the platen 9. A portion 24*a* of the ribbon 24 is exposed from the cassette 21 to the outside through the apertures 30 and 31. The one ribbon aperture 30 is provided with a first ribbon guide arm member (hereinafter referred to simply as first member) 32 which is formed integrally with the housing 22 and constitutes first ribbon guide arm means. The first member 32 extends from the corner portion 21*a* toward the platen 9 so as to guide the ribbon 24 in movement. For the other ribbon aperture 31, a second ribbon guide arm member (hereinafter referred to simply as second member) 33 constituting second ribbon guide arm means is removably attached to the cassette 21.

A coupling portion 34 of the cassette 21 to be fitted with the second member 33 is integral with the housing 22 and defines the aperture 31, projecting to the right of FIGS. 1 and 2. When the second member 33 is set in position, the ribbon 24 passed through the aperture 31 is guided toward the platen 9 through a ribbon guide passage 35 which is formed in the second member 33. Thus, the exposed ribbon portion 24*a* is stretched between the first and second members 32 and 33.

The ribbon portion 24*a* passes between the printing head 12 and the platen 9 and defines an effective printing ribbon length R.

When the second member 33 is on the ribbon cassette 21, as shown in FIG. 1, the first member 32 is in a fixed position beyond the left-hand end of the traveling stroke S, and the second member 33 is substantially in the middle of the traveling stroke S. Accordingly, the effective printing ribbon length R covers substantially half the traveling stroke S. Printing is permitted within the range of the effective printing ribbon length R.

A stepped mounting recess 36 communicating with the notch portion 4 is formed in the top surface of the right-hand side portion 7 of the cover member 3. A pair of engaging stud members 37 protrude from the left-hand edge portion of the recess 36, spaced longitudinally. Each stud member 37 has a T-shaped cross section, extending at right angles to the plane of the cover member 3.

In the mode shown in FIG. 2, the second member 33 is disengaged from the coupling portion 34 of the cassette 21 and attached to the mounting recess 36 of the cover member 3. The ribbon 24 is passed through the second member 33. Namely, the ribbon 24 is drawn out long from the ribbon aperture 31, passed through the passage 35 of the second member 33, and then turned so that the ribbon portion 24a is stretched between the first and second members 32 and 33.

In this case, the second member 33 is located beyond the right-hand end of the traveling stroke S of the printing head 12. Thus, the effective printing ribbon length R is longer than the traveling stroke S, that is, the former fully covers the latter. Accordingly, the printing head 12 can perform printing throughout the maximum printing width.

Since the selective attachment or removal of the second member 33 to or from the ribbon cassette 21 or the cover member 3 is performed by manually controlling the second member 33, especially an operating knob 38 thereon, an operator can smoothly accomplish the operation without soiling his hand with ribbon ink.

Even if the ribbon length R is extended as shown in FIG. 2, the region covered by the extended ribbon is narrow in longitudinal width, although its transverse length is increased. Therefore, this ribbon region is only just wide enough to overlap the region in which the printing head 12 is allowed to reciprocate, and is fully covered by the notch portion 4. Accordingly, the lower portion of the cover member 3 in which the motor 20 is located can fully be utilized as the layout space for the motor 20 and other components without interfering with the ribbon region.

Although the mounting recess 36 is formed in the one side portion 7 of the cover member 3 in this embodiment, it may alternatively be formed in the supporting frame 2.

The ribbon cassette 21 serving as the ribbon supply means and the first and second members 32 and 33 as the first and second ribbon guide arm means constitute the ribbon guide device according to the present invention. Moreover, the construction of the mounting recess 36 in the cover member 3 forming a part of the machine frame may be added as a component of the ribbon guide device.

Figure 3:
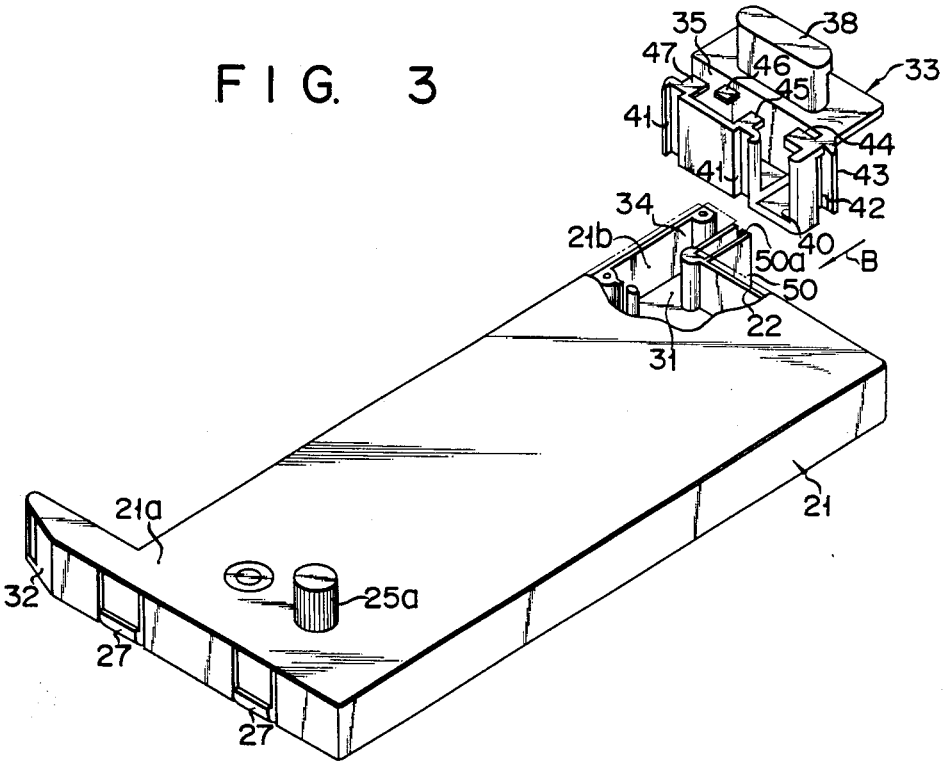
FIG. 3 is a perspective view showing the ribbon cassette and the second ribbon guide arm member disengaged from each other.
Figure 4:
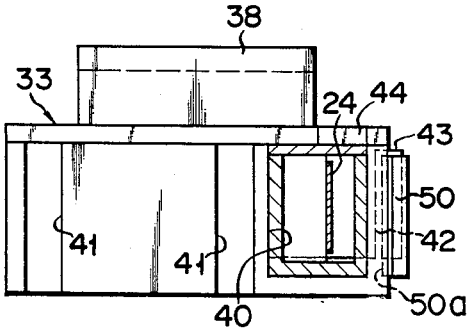
FIG. 4 is a sectional view taken along line IV—IV of FIG. 1.
Figure 5:
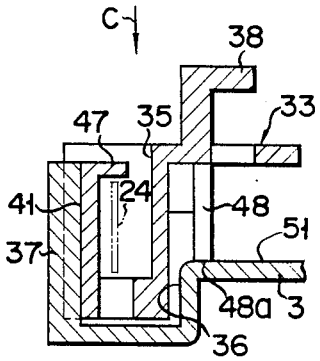
FIG. 5 is a sectional view taken along line V—V of FIG. 2.

Referring now to FIGS. 3 and 4, the construction of the second member 33 and the coupling portion 34 of the ribbon cassette 21 will further be described.

The second member 33 is integrally formed from plastic material as a single block-shaped member. A fitting opening 40 to engage the coupling portion 34 of the cassette 21 is formed in one side face of the second member 33. The fitting opening 40 connects with one end of the passage 35. Also, a pair of channel-shaped engaging grooves 41 are formed in the same side face, spaced and vertically extending parallel to each other.

A channel-shaped vertical engaging groove 42 and a projected edge 43 extending along the groove 42 are formed on the other side face of the second member 33.

Projected pieces 44, 45, 46 and 47 are formed on the top surface of the second member 33, spaced so as to define the upper end of the passage 35, thereby preventing the ribbon 24 from easily slipping out upwardly from the passage 35.

As shown in FIG. 1, a pair of abutting pieces 48 are arranged below the operating knob 38.

At the coupling portion 34, a click member 50 capable of elastic deformation is formed integrally with the housing 22, and a hook 50a is formed at the extreme end of the member 50 by bending.

The second member 33 is slidably attached to the coupling portion 34 along the direction parallel to the main surface of the cassette 21, i.e., along a horizontal plane, as indicated by arrow B in FIG. 3. In other words, the attachment direction of the second member 33 is horizontal. In inserting the coupling portion 34 into the fitting opening 40, the click member 50 flexibly engages the lateral face of the second member 33 so that the hook 50a is fitted in the engaging groove 42. As a result, the attachment position of the second member 33 relative to the cassette 21 is settled, and the second member 33 is releasably held in this attachment position. Thus, the click member 50 and the engaging groove 42 constitute detent means for positioning. The engagement between the end face of the hook 50a and the projected edge 43 additionally ensures the attachment condition.

In the attached state, the aperture 31 connects with the passage 35. Preferably, the ribbon 24 is passed through the passage 35 of the second member 33 before the attachment of the second member 33. The ribbon 24 can be inserted into the passage 35 from above the second member 33 without interfering with the projected pieces 44 to 47.

In removing the second member 33, the hook 50a is disengaged from the engaging groove 42 by moving the operating knob 38 sideways with a small force, and the coupling portion 34 can then be drawn out from the fitting opening 40.

The second member 33 can securely be held in the attachment position by frictional force if the frontage of the fitting opening 40 is somewhat narrowed so that the coupling portion 34 can be mounted by utilizing the elastic deformation of the material of the second member 33, and if the extreme end portion of the coupling portion 34 is so designed as to abut against the side wall portion of the second member 33. In this case, the engaging groove 42 and the engaging click member 50 may be omitted.

In the attached state, moreover, the coupling portion 34 is elastically held between the projected piece 44 and the bottom surface of the fitting opening 40, so that the second member 33 is prevented from moving vertically.

Referring now to FIGS. 2 to 5, there will be described the way the second member 33 is attached to the mounting recess 36 of the cover member 3.

The second member 33, loaded with the ribbon 24, is moved to the position over the mounting recess 36. Then the second member 33 is lowered in a direction perpendicular to the plane of the cover member 3, as indicated by arrow C in FIG. 5, so that the engaging grooves 41 (FIG. 3) are caused to frictionally engage their corresponding engaging stud members 37. When bottom ends 48a of the abutting members 48 engage a stepped portion 51 of the cover member 3, the attachment position of the second member 33 is determined. Thus, the member 33 is releasably held in the attachment position by a frictional force produced by the engagement between the engaging stud members 37 and the engaging grooves 41.

The stud members 37, engaging grooves 41, abutting members 48, and stepped portion 51 constitute mounting means for securing the second member 33 to the mounting recess 36.

Thus, the second member 33 is slidably attached to the cover member 3 at right angles to the plane thereof.

The second member 33 may easily be removed from the cover member 3 by pulling up the operating knob 38 against the frictional force to disengage the engaging grooves 41 from the stud members 37.

The removed second member 33 can be attached again to the ribbon cassette 21, as shown in FIG. 1. In this case, the slack of the exposed ribbon portion can be removed by manually turning a rotating knob 25*a* (FIG. 3) on the top end of the feed roller 25 to conceal the extra part of the exposed ribbon portion in the ribbon chamber 23.

When used up, the cassette 21 can easily be unloaded from the printing machine by inserting a finger into the finger recess 6 and then lifting up the cassette 21 by the finger.

Thus, only a small storage space will be required if the cassette 21 is kept fitted with the second member 33 in storage. Alternatively, the second member 33 may be stored separately from the cassette 21. In this case, the cassette 21 can enjoy a further compact configuration.

Although the second member 33 is described as being capable of attachment and detachment in the embodiment described above, it may be replaced with the first member 32.

What is claimed is:

1. A ribbon guide used in a printing machine which comprises a platen, a printing head capable of reciprocating along a printing line on the platen and defining a predetermined traveling stroke, a supporting frame for supporting the platen and the printing head, and a cover member for covering a top surface of the printing machine, said ribbon guide comprising:

ribbon supply means containing a ribbon mounted on the cover member, said supply means having a pair of ribbon apertures which are formed at two respective adjacent corner portions toward the platen, said ribbon being partially exposed from the ribbon supply means through the ribbon aperture;

said cover member having a pair of side portions and a notch portion therebetween thereby allowing the printing head to move throughout the traveling stroke thereof, and a holding recess communicating with the notch portion and adapted to removably hold the ribbon supply means therein, each of said side portions being disposed at a respective side of said notch portion;

first ribbon guide arm means provided on the ribbon supply means so as to face one of the ribbon apertures and extend from one of said corner portions toward the platen thereby to movably support the ribbon portion exposed through said one ribbon aperture;

second ribbon guide arm means detachably mounted on the other of said corner portions of the ribbon supply means so as to face the other ribbon aperture to movably support the ribbon portion exposed through said other ribbon aperture, whereby the exposed ribbon portion is stretched between the first and second ribbon guide arm means and is conditioned to exert a tension in a horizontal direction on the second ribbon guide arm means;

said second ribbon guide arm means having a top surface thereon and being freed from the cover member when detached from the ribbon supply means; and mounting means adapted to detachably mount the second ribbon guide arm means, when detached from the ribbon supply means, to said one side portion of the cover member in an attachment position along a direction perpendicular to the plane of the cover member at right angles to the horizontal direction of the ribbon tension, said mounting means including a vertically extending stud member formed on one of said cover side portions and the second ribbon guide arm means, and a vertically extending groove member formed on the other of said cover side portions and the second ribbon guide arm means to slidingly and mating engage with said vertically extending stud member along the direction of said mutual vertical extension thereby positively holding the second ribbon guide arm means in the attachment position against the ribbon tension.

2. The ribbon guide device according to claim 1, wherein said vertically extending stud member includes a pair of engaging stud members formed on said cover side portion and spaced from each other, and said groove member includes a pair of channel-shaped grooves formed on said second ribbon guide arm means to individually engage with the pair of engaging members.

3. The ribbon guide device according to claim 1, wherein said second ribbon guide arm means includes a ribbon guide passage through which the exposed ribbon portion is guided, said ribbon guide passage being opened upwardly at the top surface of the second ribbon guide arm means so that the exposed ribbon portion is inserted into the ribbon passage from above the second ribbon guide arm means, and a plurality of projected pieces which are formed on the top surface and spaced away from each other to extend above the ribbon guide passage, thereby preventing the exposed ribbon portion from easily slipping out upwardly from the guide passage while the exposed ribbon portion is allowed to be inserted into the guide passage without interfering with the projected pieces.

4. The ribbon guide device according to claim 1, wherein said second ribbon guide arm means includes an operating knob for manual attachment or detachment of the second ribbon guide arm means to or from the ribbon supply means and the cover member.

5. The ribbon guide device according to claim 4, wherein said second ribbon guide arm means is integrally formed from plastic material as a single member.

6. The ribbon guide device according to claim 1, wherein said cover member further has a finger recess continuous with the holding recess, so that the ribbon supply means can be easily removed from the holding recess by the insertion of a finger into the finger recess.

7. The ribbon guide device according to claim 1, wherein said first ribbon guide arm means takes a fixed position beyond one end of the traveling stroke of the printing head, and said second ribbon guide arm means takes a position beyond the other end of the traveling stroke of the printing head when mounted on said one side portion of the cover member by the mounting means, so that the exposed ribbon portion stretched between the two ribbon guide arm means covers the whole traveling stroke of the printing head.

8. The ribbon guide device according to claim 1, wherein said ribbon supply means includes a planar rectangular ribbon cassette, and said pair of ribbon apertures are formed at two adjacent corner portions or the ribbon cassette.

9. The ribbon guide device according to claim 8, wherein said second ribbon guide arm means is slidably attached to or removed from the ribbon cassette along a horizontal plane.

* * * * *